US005539983A

United States Patent [19]

Reyburn et al.

[11] Patent Number: 5,539,983

[45] Date of Patent: Jul. 30, 1996

[54] SAFETY STOCK CARTON KNIFE

[76] Inventors: Thomas P. Reyburn, 127 E. Maple, Fruitport, Mich. 49415; Frederick S. Reyburn, 19030 Fruitport Rd., Spring Lake, Mich. 49456

[21] Appl. No.: 393,059

[22] Filed: Feb. 23, 1995

Related U.S. Application Data

[63] Continuation of Ser. No. 291,450, Aug. 17, 1994, Pat. No. 5,412,871.

[51] Int. Cl.[6] ..... B67B 7/00

[52] U.S. Cl. ..... 30/2; 30/286; 30/294

[58] Field of Search ..... 30/2, 286, 289, 30/294, 295, 317

[56] References Cited

U.S. PATENT DOCUMENTS

| | | | |
|---|---|---|---|
| D. 254,243 | 2/1980 | Florian | D8/98 |
| 601,315 | 3/1898 | Creveling | 30/294 |
| 1,498,753 | 6/1924 | Rendlich | 30/286 |
| 1,546,975 | 7/1925 | Feller | 30/286 |
| 2,681,502 | 6/1954 | Black | 30/286 |
| 2,764,814 | 10/1956 | Jecker | 30/317 |
| 3,092,903 | 6/1963 | Bockhold | 30/2 |
| 3,100,935 | 8/1963 | Leafe | 30/294 |
| 3,178,812 | 4/1965 | Lurie | 30/2 |
| 3,187,354 | 6/1965 | Frisbie | 7/14.1 |
| 3,324,548 | 6/1967 | Mascia | 30/125 |
| 3,600,806 | 8/1971 | Naccash | 30/294 |
| 3,673,687 | 7/1972 | Phillips | 30/294 |
| 4,048,719 | 9/1977 | Thompson | 30/2 |
| 4,086,698 | 5/1978 | Sparks | 30/2 |
| 4,167,810 | 9/1979 | Gilbert | 30/2 |
| 4,198,751 | 4/1980 | Egbert | 30/286 |
| 4,489,489 | 12/1984 | Sarto | 30/2 |
| 4,631,829 | 12/1986 | Schmidt | 30/294 |
| 4,662,070 | 5/1987 | Reddig | 30/294 |
| 5,054,198 | 10/1991 | Gmoch | 30/2 |
| 5,142,780 | 9/1992 | Brewer | 30/294 |
| 5,282,316 | 2/1994 | Anderson | 30/294 |
| 5,412,871 | 5/1995 | Reyburn et al. | 30/2 |

*Primary Examiner*—Hwei-Siu Payer

*Attorney, Agent, or Firm*—Price, Heneveld, Cooper, DeWitt & Litton

[57] ABSTRACT

A stock carton knife comprising an elongated handle having a pair of ends, a blade projecting from one end of the handle and having two lateral edges and an outer end, a lateral cutting notch in one of the lateral edges having a sharpened cutting edge and a laterally oriented mouth and including an inner sharp edge closer to the handle and an outer sharp edge farther away from the handle, the outer edge converging with the blade end to form a juncture with a blunt knob, the mouth being smaller in width than about one centimeter, and a diagonal guard plate on the blade along the inner edge, normal to and astraddle of the blade, with a first surface area toward the handle to protect the fingers of a user, and a second surface area toward the notch to limit depth of cut by the blade into a carton.

3 Claims, 1 Drawing Sheet

SAFETY STOCK CARTON KNIFE

This is a continuation of application Ser. No. 08/291,450 filed Aug. 17, 1994, now U.S. Pat. No. 5,412,89 .

BACKGROUND OF THE INVENTION

This invention relates to a shipping carton opening knife, and more particularly to a safety carton knife that protects the user and the carton contents.

A common, everyday activity experienced in most stores, e.g., grocery stores, is the opening of dozens or hundreds of shipping cartons of cardboard or paperboard, i.e., boxes, to remove and stock the product contained therein. The usual technique for opening the cartons is by quickly cutting the cartons with the sharp blade of a knife. Typically this is done by rambunctious teenagers. Unfortunately, there are two all too common detrimental happenings which can occur during this activity. One thing which happens is injury to the person by his/her own knife. Available statistics indicate that the related injuries to store employees can be thousands of dollars per year because of this type of accident. The other occurrence is damage to the product contained in the carton. For example, individual paperboard or plastic packages of food, cereal, clothing, etc. are frequently sliced by the knife. This damage is understood to be in the range of about five billion dollars per year in the U.S.

SUMMARY OF THE INVENTION

An object of this invention is to provide a stock knife which is safe for the user and which inhibits damage to the container contents.

The novel knife has a handle and a blade with a lateral cutting notch. The laterally oriented mouth of the notch is smaller in width than a centimeter so that a person's finger will not fit therein. A blunt knob is at the juncture of the cutting notch edge and the outer end of the blade, so that no sharp point is exposed. A transverse, diagonal guard plate is at the inner edge of the notch, with one surface facing toward the handle to protect the user's fingers, and an opposite surface facing toward the notch to limit depth of cut by the blade into a carton.

These and several other objects, advantages and features of the novel knife will be apparent upon studying the following specification in conjunction with the drawings.

DESCRIPTION OF THE PREFERRED EMBODIMENT

Figure 1:
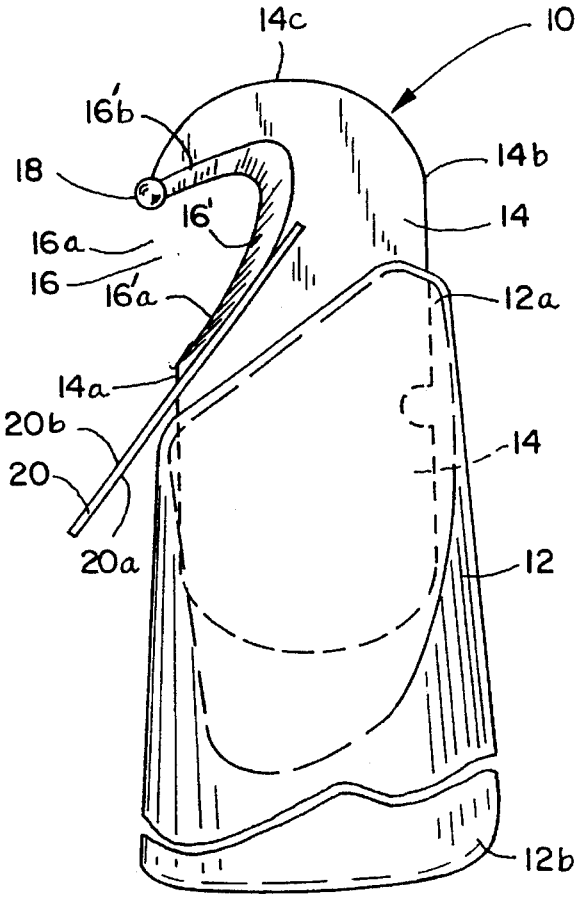
FIG. 1 is a side elevational view of a knife of this invention.
Figure 2:
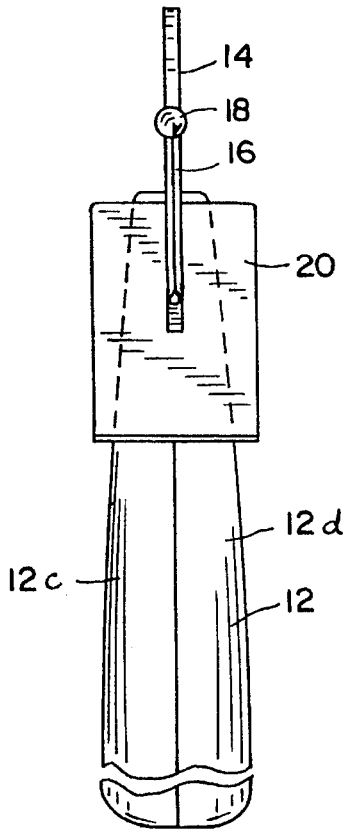
FIG. 2 is a front elevational view of the knife, viewed from the left side of FIG. 1.

Referring now to the drawings, the stock carton knife 10 there depicted comprises an elongated handle 12 having a pair of ends 12*a* and 12*b*. This handle can be made in typical fashion of two halves 12*c* and 12*d* (FIG. 2) which interfit with each other and are secured together as by a conventional threaded fastener (not shown). These secure a blade 14 therebetween, the blade projecting from end 12*a* of handle 12. The exposed end of blade 14 has a pair of blunt, i.e., dull, lateral edges 14*a* and 14*b* which form the front and back edges of the blade, and a rounded, convex, dull outer end 14*c*. In edge 14*a* is a lateral cutting notch 16 which has a sharpened cutting edge 16' and a laterally opening mouth 16*a*. Notch 16 is generally diagonally oriented relative to the elongated dimension of the knife, extending diagonally from mouth 16*a* toward the outer end 14*c* of blade 14. Cutting edge 16' includes a sharp inner edge 16'*a* closer to the handle 12, and a sharp outer edge 16'*b* further away from the handle and closer to the outer end 14*c*. This outer edge 16'*b* joins end 14*c* of the blade with a blunt knob 18 at this outer juncture. This knob has a width greater than the blade width, and preferably is in the form of a sphere, but may take other blunt configurations, so that there is no sharp point at this outer edge of mouth 16*a*.

Figure 3:
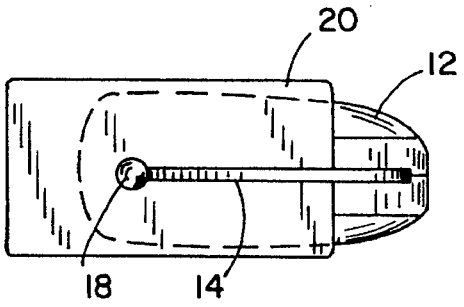
FIG. 3 is a top plan view of the knife, i.e., looking down from the top of FIG. 1.

Along the inner edge 16'*a* is a diagonal guard plate 20 extending generally parallel to edge 16'*a*, and which is normal to blade 14. It straddles the blade so as to protrude from the two opposite faces of blade 14 in the manner depicted in FIGS. 2 and 3. This guard plate has a first surface area 20*a* which is oriented toward the handle, to protect the fingers of a user of the knife. It also has a second opposite surface area 20*b* oriented toward the notch. This plate is immediately adjacent to and along the cutting edge 16'*a* to cause surface 20*b* to limit the depth of cut by the blade into a carton. In use, therefore, blade 14, clamped between the two halves 12*c* and 12*d* of handle 12, with lateral notch 16 straddled by blunt knob 18 at one edge and guard plate 20 at the other edge, is forced into the carton, the depth of the puncture being limited by guard plate 20, and then pulled along the carton to cut it, the guard plate serving to protect the fingers and also to limit the depth of blade penetration into the carton.

Conceivably certain details of the preferred embodiment shown could be altered. Hence, the invention is not intended to be limited except by the scope of the claims and the reasonably equivalent structures to those defined in the claims.

The embodiments of the invention in which an exclusive property or privilege is claimed are defined as follows.

1. A safety stock carton knife comprising an elongated handle having a pair of ends;

a blade projecting from one of said ends of said handle and having two lateral edges and an outer end;

said blade having a lateral cutting notch in one of said lateral edges, said cutting notch having a sharp cutting edge and having a laterally oriented mouth including an inner sharp edge closer to said handle and an outer sharp edge farther away from said handle;

said outer edge converging with said outer end to form an outer juncture, and said outer juncture having a blunt knob;

said mouth being smaller in width than about one centimeter.

2. The safety stock carton knife in claim 1 wherein said notch is diagonally oriented relative to the elongated handle, extending diagonally from said mouth toward said blade outer end.

3. The safety stock carton knife in claim 2 wherein said blade has an inner juncture of said inner sharp edge and said one lateral edge.

* * * * *

UNITED STATES PATENT AND TRADEMARK OFFICE

CERTIFICATE OF CORRECTION

PATENT NO. : 5,539,983
DATED : July 30, 1996
INVENTOR(S) : Reyburn et al.

It is certified that error appears in the above-indentified patent and that said Letters Patent is hereby corrected as shown below:

Column 1, line 4;

"5,412,89 ." should be –5,412,871–.

Signed and Sealed this

Eighteenth Day of February, 1997

*Attest:*

Bruce Lehman

BRUCE LEHMAN

*Attesting Officer*

*Commissioner of Patents and Trademarks*